US006880369B2

(12) United States Patent
Parsons

(10) Patent No.: US 6,880,369 B2
(45) Date of Patent: Apr. 19, 2005

(54) COMBINATION HANDCUFF KEY AND WRITING INSTRUMENT

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 232 days.

(21) Appl. No.: 10/637,162

(22) Filed: Aug. 8, 2003

(65) Prior Publication Data

US 2005/0028570 A1 Feb. 10, 2005

(51) Int. Cl.[7] ..... E05B 75/00
(52) U.S. Cl. ..... 70/16; 70/456 R
(58) Field of Search ..... 70/16, 456 R; 206/37.1

(56) References Cited

U.S. PATENT DOCUMENTS 4,778,302 A * 10/1988 Martinez ..... 401/195
5,460,022 A * 10/1995 Parsons ..... 70/456 R
5,568,741 A * 10/1996 Parsons ..... 70/456 R
5,704,236 A * 1/1998 Parsons ..... 70/456 R
5,937,680 A * 8/1999 Parsons ..... 70/456 R

* cited by examiner

*Primary Examiner*—John B. Walsh
(74) *Attorney, Agent, or Firm*—Welsh & Katz, Ltd.

(57) ABSTRACT

A combination handcuff key and writing instrument finds particular application with law enforcement and security personnel and includes an elongated pen having a writing end and an opposite closed end, and a cap adapted to selectively receive either the writing end or the closed end of the pen. A paddle type handcuff key is formed on a closed end of the cap so as to extend longitudinally from the cap. With the writing end of the pen inserted into an open end of the cap, the writing element is protected and the pen and cap form a hand-holdable handle for the handcuff key that can be conveniently carried on the user's person for easy access. With the closed end of the pen inserted into the cap, a longer length pen for writing is created. The writing element preferably is of the ball point pen type enabling use to double lock a handcuff. An external clip on the cap facilitates attachment to the user's person and enables ready orientation of handcuff key when the cap is disposed in the user's hand. In either configuration, the key element is exposed and useable.

27 Claims, 1 Drawing Sheet

COMBINATION HANDCUFF KEY AND WRITING INSTRUMENT

FIELD OF THE INVENTION

The present invention relates generally to keys for unlocking restraining devices, such as handcuffs as generally used by law enforcement and security personnel, and more particularly to a combination handcuff key and writing instrument that can be readily carried on one's person for convenient access and where the key is supported on an outer closed end of a cap of a ball point type writing instrument, the cap being adapted to releasably receive the writing end of the pen body in compact connected relation, or receive an opposite closed end of the pen body to establish a longer length writing instrument.

BACKGROUND OF THE INVENTION

It is a common practice for law enforcement and security personnel to carry one or more restraining devices, such as handcuffs, on their person when carrying out an operation where restraining devices may be deployed. Such restraint devices are generally used when needed to secure a subject's wrists for restricted hand and arm movement. Typical wrist restraint devices take the form of metallic handcuffs that include lock mechanisms operative to prevent unintended release of the handcuffs once applied to a subject's wrists. The keys for releasing handcuff lock mechanisms are generally relatively small, have an unlocking paddle mounted on or formed integral with a shank in a generally "L" shaped profile, and are typically adapted to be retained on a key ring. However, due to the size and configuration of other keys carried on the key ring, and the key ring configuration itself, a handcuff key can sometimes be difficult to quickly locate by security and law enforcement personnel who carry a key ring having a plurality of keys thereon besides the handcuff key. Other problems sometimes experienced by personnel whose duties require that they carry such handcuff keys include snagging of the generally "L" shaped key on the user's clothing, such as pants or a jacket pocket in which the key ring is carried, often ripping the pocket or adjacent clothing.

Another problem sometimes experienced with such handcuff keys is the potential for injury due to the key jabbing the leg of a person who carries the key in his pocket or on a key ring carried on the person's belt so that the keys dangle. Because the key is generally "L" shaped, the locking paddle or tooth of the key, which is generally perpendicular to an elongated key handle or shank, is typically disposed perpendicular to the officer's leg and can be inadvertently forced against the leg in a jabbing action so a to cause pain and injury, in addition to damaging the clothing. Further, as noted, handcuff keys are relatively small and are typically held on the same key ring as other keys (including, for example, car keys, office keys and the like), so that it can be difficult to quickly locate the handcuff key on the key ring. Moreover, even after the handcuff key is located, it is often difficult to manipulate the key to a position to open a restraint device when carried on a heavy or over-laden key ring. This can lead to endangerment of the officer if his or her attention is directed away from an apprehended suspect. Also, because keys are often kept in one's pocket, in some situations it can be inconvenient for another officer to have access to the handcuff key when the officer having possession of the key is incapacitated or unable to assist in the retrieval of the keys.

It has generally been considered impractical to change the shape of known handcuff keys because of the large number of handcuffs presently in existence that use only this key design. Typically, all police keys and handcuffs are interchangeable, and changing the basic key configuration can have significant economic and operational impact. Furthermore, keys of a different shape may still exhibit at least some of the aforementioned problems in respect to quick retrieval and use when carried on a key ring.

Attempts have been made to solve the aforedescribed problems associated with known handcuff keys. See, for example, U.S. Pat. No. 5,568,741 ("the '741 patent") that is assigned to the assignee of the present invention and incorporated herein by reference. This patent discloses different embodiments of a handcuff key in combination with other commonly used devices. For example, the key can be concealed inside a pen enclosure, such as beneath the pen cap, or in a folding pocketknife as a separate "blade," or in other novelty casings, such as a nail clipper or pocket-folding tool. One of the purposes of the devices disclosed in the '741 patent is to provide concealed placement of a handcuff key. Such concealment is often important in undercover assignments and crowd control where concealment is necessary to the officer's safety, but is generally unnecessary in day-to-day assignments where convenience and ease of use of a handcuff key are paramount considerations. Under any condition, a handcuff key should be readily accessible and usable without undue loss of time during retrieval and preparation for use.

SUMMARY OF THE INVENTION

In accordance with the present invention, a writing pen and key combination is provided that allows for convenient and safe placement of a handcuff key. The combination includes a writing pen of the type having a separate elongated pen body and a cap adapted to receive at least a portion of the pen body. The pen body is generally tubular and has a writing end, preferably of the ball point type, and an opposite closed end. The pen body is tapered so that the closed end is of greater diameter than the diameter of the writing end. An elastomeric ring preferably encircles the pen body so as to establish an annular stop surface approximately mid-length of the pen body. The pen cap has a generally tapered tubular shell closed at one end and open at its opposite end into which either the first or second end of the pen body can be inserted. The pen body and cap are configured so that the writing end of the pen body can be inserted farther into the cap for storage than can be the second closed end. The closed end of the cap has a key fixed externally thereon so that a shank of the key is coaxial with the longitudinal axis of the pen and has a radial paddle fixed thereon. When the writing end of the pen is inserted into the cap, the combination pen body and cap establish a compact key and handle. When the second or closed end of the pen is inserted into the cap such that the writing end is in an exposed writing mode position, a writing instrument is created having a greater length than when the writing end of the pen is stored within the cap in a closed mode. In one embodiment, the pen and cap are configured so as to establish a writing mode length that is approximately twice the length of the pen writing end storage or closed mode configuration. In the closed mode, the greater diameter exposed portion of pen body and the cap provide a comfortable grip handle that enables the user to apply a desired rotational torque to the handcuff key.

Means, such as a relatively stiff but flexible clip, are preferably formed integral with or otherwise freely mounted on the cap to facilitate releasable attachment of the combination pen and key to the user's clothing, as on a pocket edge or the like, for convenient access. The clip is disposed diametrical opposite the radial paddle portion of the key so as to enable immediate orientation of the handcuff key relative to the user's hand for use with a handcuff lock.

Further objects, features and advantages of the combination handcuff key and writing instrument in accordance with the present invention will become apparent from the following detailed description taken in conjunction with the accompanying drawing in which like reference numerals designate like elements throughout the several views.

DETAILED DESCRIPTION

Figure 1:
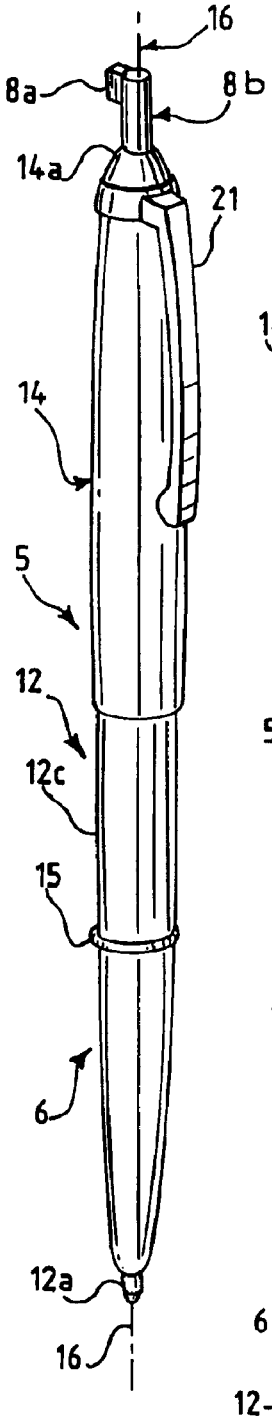
FIG. 1 is a perspective view of a combination pen and handcuff key in accordance with the present invention shown with the pen tip exposed for use in a writing mode position or for use to double lock a pair of handcuffs.

While the present invention is susceptible of various forms, there is shown in the drawings a preferred embodiment that is discussed in greater detail hereafter. It will be understood that the present disclosure is to be considered as an exemplification of the present invention, and is not intended to limit the invention to the specific embodiment illustrated. As an example, the clip may be on the same side and still provide an officer with an indication of the proper orientation of the key. It will be further understood that the title of this section of this application ("Detailed Description") relates to a requirement of the United States Patent and Trademark Office, and should not be found to limit the subject matter disclosed herein.

Referring now to the drawing, FIGS. 1–4 illustrate a combination writing pen and handcuff key, indicated generally at 5, constructed in accordance with a preferred embodiment of present invention. The combination includes a writing pen 6 and a handcuff key 8. The writing pen 6 includes a pen body 12 having a writing end 12*a* and an opposite closed end 12*b*, and a cap 14 having a closed end 14*a* and an open end 14*b*. The pen 6 defines a rectilinear longitudinal axis represented by line 16.

The handcuff key 8 is of conventional design and is affixed to the distal end 14*a* of cap 14. The handcuff key 8 is generally L-shaped and includes a rectangular suitable strength metallic paddle or latch tab 8*a* that may be secured radially to or formed integral with a metallic cylindrical shank 8*b* that in turn is affixed to the distal end 14*a* of cap 14 so that the shank is coaxial with the longitudinal axis 16 of the pen 6. The cap 14 is preferably made of a formed suitable strength metallic material, such as aluminum or brass, that lends itself to an external paint finish, such as a baked enamel, or a metallic finish such as anodizing, plating, or the like. It will be understood that the shank 8*b* can be secured to the metallic cap 14 by a variety of techniques depending on the material from which the cap is made, including welding, brazing or soldering, a suitable adhesive, or by a mechanical fastening means such as a threaded connection, as long as the shank and paddle can withstand repeated rotation torque during use of the key to unlock a restraint device. It will be appreciated that affixing the key 8 to the cap by a threaded connection enables removal of the key from the cap, if desired, thereby enabling the key to be replaced with another key (not shown) for use with a different handcuff lock.

Figure 2:
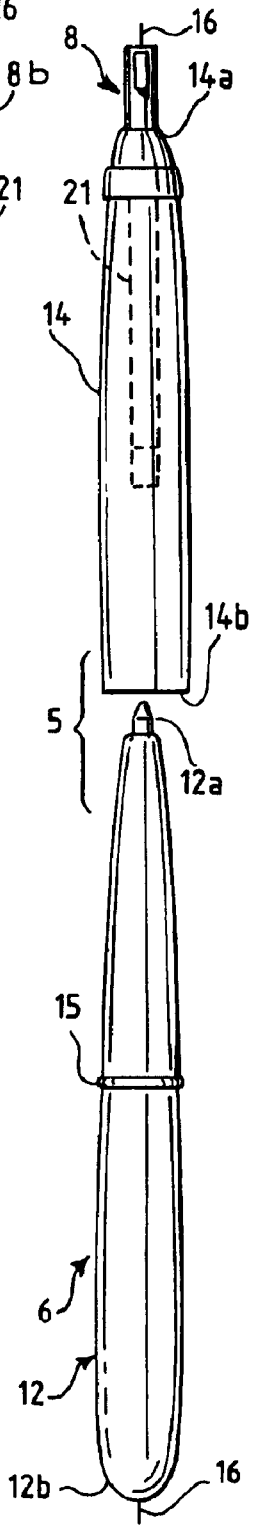
FIG. 2 is an exploded perspective view of the combination pen and handcuff key of FIG. 1 but illustrating the writing end of the pen preparatory to inserting it into the cap in a stored or closed mode position.
Figure 4:
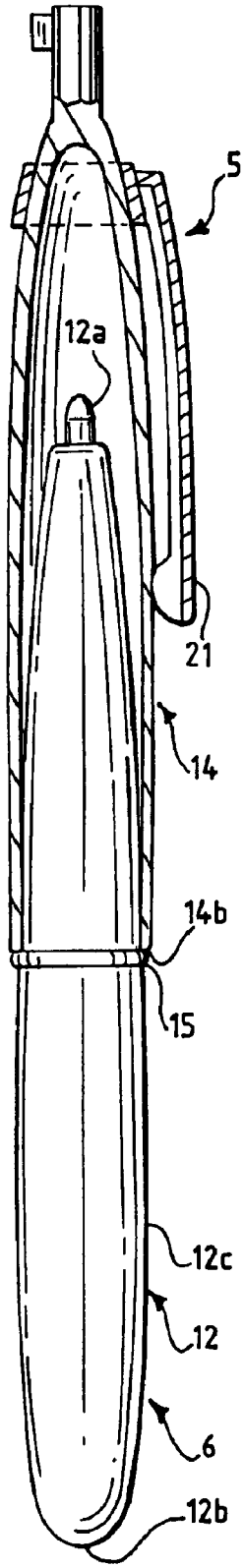
FIG. 4 is a perspective view of the combination pen and handcuff key in its closed mode position as in FIG. 3 but showing the cap in longitudinal section to illustrate the writing end of the pen in the stored position.

The pen 6 in the illustrated embodiment is preferably a ballpoint type pen, such as a Fisher Space Pen available from Fisher Space Pen Co. The pen body 12 has a circular transverse cross sectional configuration throughout substantially its full length and may be made of a suitable strength rigid material such as metal, plastic or other conventional hardened material. As illustrated in FIG. 2, the pen body 12 tapers outwardly from the writing tip end 12*a* to an area or length of maximum diameter, indicated generally at 12*c*, after which the pen body is formed with the rounded closed end 12*b*. The larger diameter area 12*c* of the pen body is sized in relation to the open end and internal recess in the cap 14 to limit insertion of the closed end of the pen body into the cap, as will be described. An annular elastomeric ring 15, such as a rubber O-ring, is preferably mounted on the pen body 6 so as to seat within an annular external groove formed about the pen body at generally its mid-length. The ring 15 serves to engage the inner surface of the cap 16 when the writing end 12*a* of the pen is inserted into the cap so as to limit insertion of the writing end and frictionally retain the writing end within the cap, as illustrated in FIG. 4. However, substantially any pen that has a removable cap operative to firmly receive the writing end of a pen and enable attachment of the key 8 fixed to the closed end of the cap may be used.

In a preferred embodiment, the pen cap 14 has a conventional attachment clip 21 mounted thereon to facilitate attachment of the combination handcuff key and writing instrument to the user's clothing, such as the fabric edge of a shirt jacket or pants pocket or the like such that the combination handcuff key and writing pen can be carried on an officer's person in a desired location for ready access. The attachment clip 21 is preferably fixedly attached to the pen cap 14 so as to extend longitudinally from the pen cap diametrically opposite the radial paddle portion 8*a* of the handcuff key 8. Alternatively, the clip 21 could be of the removable type such that it can be fixed on the pen cap or removed as desired but always diametrically opposite the handcuff key paddle.

Figure 3:
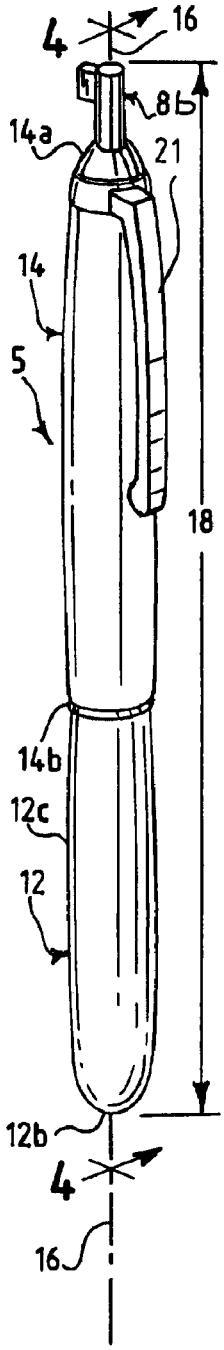
FIG. 3 is a perspective view of the combination pen and handcuff key of FIG. 2 but shown in the closed mode position having the writing end of the pen fully inserted within the pen cap and illustrating the attachment clip diametrically opposite the handcuff key.

Referring to FIGS. 3 and 4, the pen 6 is shown in a closed or capped mode such that ball point pen writing end 12*a* is encased within cap 14. In this configuration the closed end 12*b* of the pen body and the closed end 14*a* of the cap and associated handcuff key 8 create a shortened pen length 18 allowing for ease of storage. In the embodiment illustrated in FIGS. 3 and 4, the length 18 of the pen in the closed position with the cap is approximately half the length of the pen in the open writing position as shown in FIG. 1. The length 18 is made short enough to facilitate compact storage but also provides a convenient handle length for gripping in the palm of the user's hand and for applying a desired rotational torque to the handcuff key 8. In this configuration, the writing end 12*a* of pen 6 is protected within cap 14 so as to prevent unintended contact of the pen end with the users clothing and hands and the like to thereby enable safe storage in a pocket or other storage area. It will be understood that the pen body 12 and cap 14 may be formed with mutually cooperative releasable connecting means, such as threaded, bayonet or other conventional cooperating means that allow the cap and pen body to be releasably secured together as an alternative to use of the O-ring 15.

In use, the writing end 12*a* of the pen 6 is typically stored inside the pen cap 14 in the closed position mode. The clip 21 facilitates retention of the pen/key combination in a desired location on the user, such as clipped to the free edge of a pocket panel. The clip also enables the user to readily and quickly orient the closed mode pen/key combination in the user's hand so that the handcuff key is in the desired position for unlocking a handcuff.

In that regard, when gripping the cap 14, the user can readily feel the location of the clip 21. Once the user feels the clip 21, he or she immediately knows the relative orientation of the latch tab 8*a* of the handcuff key 8, which as illustrated, is 180 degrees relative to the clip (opposite the clip). Of course, any suitable angular orientation may be used. For example, the orientation of the latch tab 8*a* of the handcuff key 8 may be zero degrees, or on the same side of the clip 21.

When it is desired to use the writing end 12*a* to write, the user can remove the pen/key combination from his pocket, pull pen body 12 from the cap and insert the closed pen end 12*b* into the cap 14 until the enlarged diameter portion 12*c* snugly seats within the cap, thereby forming an open, writing position mode as illustrated in FIG. 1. In this position, the exposed ball point 12*a* can also be used to double lock a handcuff in a known manner. Using the reverse steps, reinserting the writing end 12*a* of pen body 6 into the cap 14 readily facilitates use of the key 8 to unlock a restraint device, or facilitates re-placing into the user's pocket or the like for safe storage. In the closed position, the combination key and pen provides a comfortable gripping handle of a desired easy-to-use length for turning the handcuff key 8 in a lock.

It will be understood that while the handcuff key 8 will most often be used when the pen end 12*a* is in its closed position within cap 14, the key 8 may also be used for unlocking handcuffs when the closed end 12*b* of the pen is disposed within the cap with the pen writing end 12*a* in an open writing mode position. It will also be understood that the cap 14 itself and the associated handcuff key 8 may be used to manipulate the handcuff key for unlocking a restraint device such that one officer could write with the pen 6 while another officer is unlocking a restraint device lock by gripping and rotating the cap 14 and key 8. In this manner, the utilitarian nature of the combination 10 is given its full range of use as a writing instrument, a handcuff key and to double lock a handcuff when in its extended length, or as a separate handcuff key when in its shorter length.

Although a preferred embodiment of the invention has been illustrated and described, it will be understood to those skilled in the art that various changes and modifications may be made therein without departing from the major aspects of the invention. Various features of the invention are defined in the following claims.

What is claimed is:

1. A pen and key combination comprising;

a pen including an elongated body and a cap, said pen body having a writing end and an opposite closed end, said cap having a closed end and an open end, the open end being adapted to selectively receive the first and second ends of the pen body therein; and a key mounted externally on said closed end of the pen cap in a manner to enable use of the key to unlock a key actuated lock device.

2. The pen and key combination of claim 1, wherein said pen body has a generally circular transverse cross-section throughout substantially its longitudinal length, a selected length of said pen body adjacent said closed end having a greater peripheral dimension that the remainder of said pen body so as to limit insertion of said closed end into said cap in a writing mode.

3. The pen and key combination of claim 2, wherein a substantial portion of said remainder of said pen body is adapted to be inserted into the cap and create a stored writing instrument mode.

4. The pen and key combination of claim 2, wherein the key can be operated to open a lock when the writing end of the pen body is inserted into the open end of the cap.

5. The pen and key combination of claim 3, wherein the key can be operated to open a lock when the writing end is exposed for writing and also when the writing end of the pen body is inserted into the cap.

6. The pen and key combination of claim 1, wherein the key is a handcuff key.

7. The pen and key combination of claim 1, wherein the key is welded to the closed end of the cap.

8. The pen and key combination of claim 1, wherein the key is adhered to the closed end of the cap with an adhesive.

9. The pen and key combination of claim 1, wherein the key is attached to the closed end of the cap by mechanical fastener means.

10. The pen and key combination of claim 8, wherein the key is removably fastened to said cap.

11. The pen and key combination of claim 3, wherein the length of the writing instrument mode is approximately twice the length of the stored writing instrument mode.

12. The pen and key combination of claim 1, wherein the pen body is tapered such that the writing end of the pen body can be inserted farther into the cap than the closed end of the pen body.

13. The pen and key combination of claim 1, wherein the pen cap includes a clip enabling attachment of the combination to an article of clothing.

14. The pen and key combination of claim 1 wherein said writing end of said pen body is adapted to enable double locking of a handcuff.

15. The pen and key combination of claim 14 wherein said writing end comprises a ball point type pen.

16. A pen and key combination comprising:

a pen of the type having a separate pen body and a separate cap, said pen body having a first end of predetermined longitudinal length and a second end of predetermined longitudinal length, at least a portion of the second end having greater circumferential dimension that the circumferential dimension of said first end, said separate cap having a closed end and an open end, the closed end of the cap having an external key extending coaxially with a longitudinal axis of the cap, said open end being adapt to selectively receive the first and second ends of the pen body; and the pen and key combination forming a handcuff key and handle of a first longitudinal length when the first end of the pen body is inserted into the pen cap, and forming a writing instrument of greater longitudinal length than aid first longitudinal length when the second end of the pen body is inserted into said separate cap.

17. A pen and key combination comprising:

a pen including a pen body and a cap and defining a longitudinal axis;

the pen body having a first writing end and a second closed end, at least a portion of the second end having a greater circumferential dimension than the circumferential dimension of the first end; and the pen cap being generally tubular and having a closed end and an open end, a key affixed externally to the closed end of said cap so as to extend generally along a longitudinal axis of the cap, the open end of said cap being adapted to receive, alternatively, the first and second ends of the pen body so as to establish a handcuff key and handle, when the first end of the pen body is inserted into the open end of the cap, and establish a key and writing instrument when the second end of the pen body inserted into the open end of cap.

18. The pen and key combination of claim 17, wherein the key is a handcuff key.

19. The pen and key combination of claim 17, wherein the key is exposed for cooperation with a lock when the pen body and cap form a handcuff key and handle.

20. The pen and key combination of claim 17, wherein the key can be employed to open a lock while the pen body and cap are in cooperating relation to establish a key and writing instrument.

21. The pen and key combination of claim 17, wherein the length of the key and writing instrument configuration is approximately twice the length of the handcuff key and handle configuration.

22. The pen and key combination of claim 17, wherein the pen body is tapered such that the first end of the pen body can be inserted farther into the open end of the cap than the second closed end of the pen body.

23. A pen and key combination comprising:

a pen of the type having a separate body and a cap mutually cooperable to define a rectilinear longitudinal axis;

the pen body having a first writing end and a second closed end, the second end having a generally annular peripheral surface coaxial with the longitudinal axis; and the cap comprising a shell having a closed end and an open end, the closed end of the cap enabling attachment of a key in coaxial relation to the longitudinal axis of the pen body, the open end being adapted to receive, alternatively, the first and second ends of the pen body such that in a first configuration the first end of the pen body is received in the cap to form a handcuff key and handle, and in a second configuration the second end of the pen body is received in the pen cap to form a writing pen, the second configuration having a longitudinal length generally greater than the longitudinal length of the first configuration.

24. The pen and key combination of claim 13 wherein the key is oriented on a same side of the pen cap as the clip.

25. The pen and key combination of claim 13 wherein the key is oriented on an opposite side of the pen cap as the clip.

26. The pen and key combination of claim 13 wherein the key is oriented at a predetermined angle relative to the clip along a longitudinal axis of the pen cap.

27. The pen and key combination of claim 26 wherein the angular orientation of the key relative to the clip facilitates identification of a position of the key by a user.

* * * * *